US008414150B1

(12) United States Patent
Simon

(10) Patent No.: US 8,414,150 B1
(45) Date of Patent: Apr. 9, 2013

(54) LED LIGHT FRAME SYSTEM INCLUDING CHANGE-OUT SYSTEM FOR LED REMOVAL AND REPLACEMENT

(76) Inventor: Jerome H. Simon, Newton Centre, MA (US)

( * ) Notice: Subject to any disclaimer, the term of this patent is extended or adjusted under 35 U.S.C. 154(b) by 317 days.

(21) Appl. No.: 12/814,011

(22) Filed: Jun. 11, 2010

Related U.S. Application Data

(60) Provisional application No. 61/268,522, filed on Jun. 12, 2009.

(51) Int. Cl.
*F21S 4/00* (2006.01)
*F21V 29/00* (2006.01)
*H01J 9/24* (2006.01)

(52) U.S. Cl. ..... 362/249.02; 362/218; 362/249.06; 362/294; 362/373; 362/646

(58) Field of Classification Search ..... 362/218, 362/249.02, 249.06, 294, 373, 646
See application file for complete search history.

(56) References Cited

U.S. PATENT DOCUMENTS

2008/0192462 A1* 8/2008 Steedly et al. ..... 362/218
2009/0290348 A1* 11/2009 Van Laanen et al. .... 362/249.02

* cited by examiner

*Primary Examiner* — Stephen F Husar
*Assistant Examiner* — James Cranson, Jr.
(74) *Attorney, Agent, or Firm* — Burns & Levinson LLP; Jerry Cohen; Harvey Kave

(57) ABSTRACT

An illumination system for creating a field of light with which the density, photometric angular distribution, of the projected light can be changed, including a series of light modules including at least one LED, a structural frame of structural rails having electrically insulating elements, within which electrical conductors pass. The structural rails are at least partially composed of a heat conductive material. There is a circuit board which has a heat conductive substrate having slots disposed about the circuit board, and including at least two electrical contact surfaces located along the slots on the circuit board. The LED is mounted to the circuit board which includes at least two electrical contact surfaces located along the slots. There are electrically conductive screws for electrically connecting the LED on the circuit board to the electrical conductors and constructed and arranged to simultaneously provide a thermal transfer from the heat conductive substrate to the structural rails. The screws have a threaded portion of such diameter that they fit within the slots of the circuit board and the heads of the screws have a larger diameter than the slots and make contact with the contact surfaces when the screws are tightened.

21 Claims, 8 Drawing Sheets

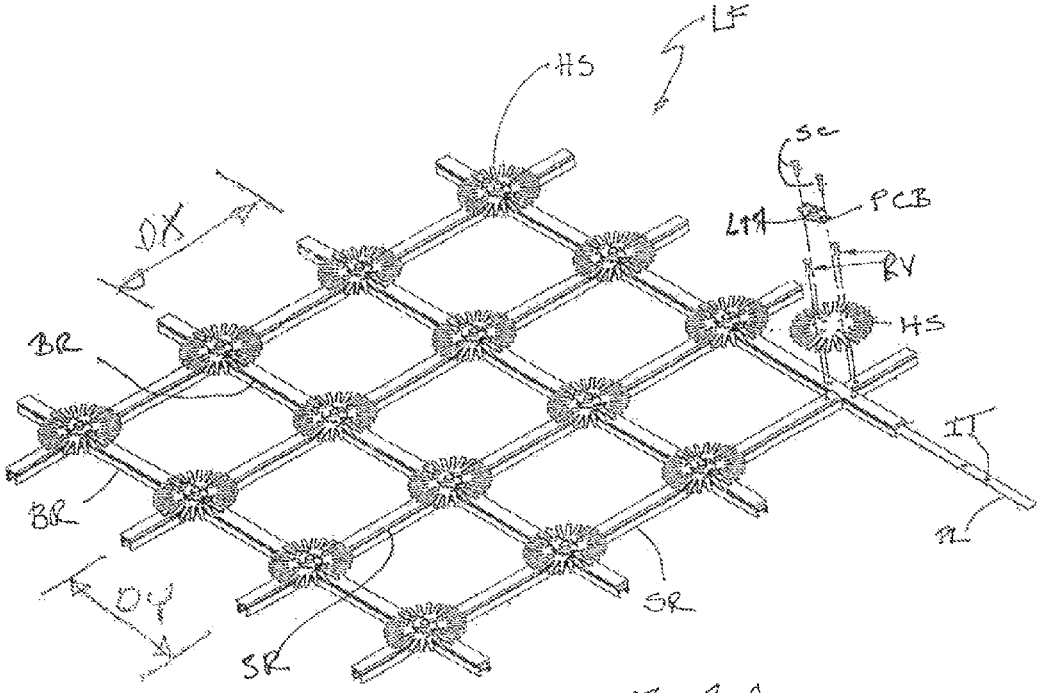
FIG 4-A

LED LIGHT FRAME SYSTEM INCLUDING CHANGE-OUT SYSTEM FOR LED REMOVAL AND REPLACEMENT

REFERENCE TO RELATED APPLICATIONS

The present application is based on and claims the priority of provisional application Ser. No. 61/268,522 filed Jun. 12, 2009. The substance of that application is hereby incorporated herein by reference.

FIELD OF INVENTION

This invention relates generally to the lighting arts, and, more particularly to an arrangement for point light sources, such as LEDs to provide the multifunction of change-out replacement of the light source, heat transfer and dissipation, and support and rigidity to the illumination structure.

SUMMARY OF THE INVENTION

It is an object of this invention to provide a structural frame for support of multiple quasi point light sources such as LEDs, the combined frame and LED components mounted thereon to project a field of light into a predetermined area of space, outdoors, within an architectural enclosure or onto a surface or on objects within a predetermined space.

It is another object of the invention to provide a system for ease of positioning and replacement of multiple quasi point light sources within a lighting system.

It is a further object of the invention to create a simplified method of construction of the structural frame, the components of the frame being designed to provide the multifunction of change-out replacement of the light source, heat transfer and dissipation, and support and provide rigidity to the illumination structure.

The present invention provides an illumination system for creating a field of light with which the density, photometric angular distribution, of the projected light can be changed, comprising a) a series of light modules including at least one LED, b) a structural frame of structural rails having electrically insulating elements, within which electrical conductors pass, the structural rails at least partially composed of a heat conductive material, c) a circuit board including a heat conductive substrate having slots disposed about the circuit board, and including at least two electrical contact surfaces located along the slots on the circuit board the LED being mounted to the circuit board, the circuit board further including at least two electrical contact surfaces strategically located along the slots, and d) electrically conductive contact screws for electrically connecting the LEDs on the circuit board to the electrical conductors and constructed and arranged to simultaneously provide a thermal transfer from the heat conductive substrate to the structural rails, the screws having a threaded portion of such diameter that they fit within the slots of the circuit board, the heads of the screws having a larger diameter than the slots and making contact with the contact surfaces when the screws are tightened.

The circuit board may include a constant current drive circuit to control the current going to the LED. A heat sink may be disposed between the heat conductive substrate and the structural rail, and held in secure contact and attached to the rails by the contact screws. The light module may be integrated into the heat sink, the heat sink including the printed circuit board, the contact surfaces and the slots. The slots in the circuit board may be disposed along a linear axis along the circuit board so that installing and removing the circuit board requires a lineal movement of the circuit board. The centers of the slots in the circuit board may be disposed along a circle so that installing and removing the circuit board requires a rotary motion, the slots being in the form of key way slots.

The cross-section of the structural rail may be a channel, the channel having linear grooves which provide positioning and assembly for the combined electrically insulating elements and electrical conductors. The combined electrically insulating elements may be a printed circuit board having connecting nuts into which the contact screws fasten. The combined electrically insulating elements and electrical conductors may be removable and may be replaced by unscrewing the contact screws and sliding the printed circuit board along the rails and out the end of the channel. The contact screws may include an insulating sleeve.

In another embodiment, the present invention provides an illumination system comprising a) a printed circuit board bonded to a heat conducting substrate, b) at least one lighting module having a quasi point light source mounted to the printed circuit board, the circuit board having at least two slots located about the circuit board, each slot at least partially surrounded by an electrical contact surface that provides electrical continuity to the quasi point light source, c) a component surface onto which the lighting module is mounted, the component surface including an insulating material through which electrical conductors are located, the electrical conductors having threaded nuts attached, the spacing between the threaded nuts being equal to the spacing between the slots in the circuit board, d) at least two electrical contact screws which, by being tightened into the threaded nuts secure the lighting module to the component surface and provide electrical continuity between electrical contact surfaces on the printed circuit board to the electrical conductors of the component surface, and e) the shape and location of the slots on the circuit board matching the location of the nuts on the conductors and being so aligned as to allow the lighting module to be removed and replaced by loosening and tightening, and not requiring the removal, of the electrical contact screws.

The lighting plane may comprise a structural frame system. The structural frame system may include structural channels. An illumination system within which at least one channel and insulator further comprising electrical conductors is disposed, the electrical conductors may have the threaded nuts to receive the electrical contact screws. The structural channels may be at least partially composed of a thermally conductive material.

The light module may include a constant current drive circuit. The slots may be disposed along a linear axis along the light module. The slots may be disposed on a circumferential axis around the quasi point light source. A heat sink may be mounted between the light module and the component surface. The light module and the heat sink may be integrated into a single component. The rails may be aluminum.

BRIEF DESCRIPTION OF THE DRAWINGS

These and other objects, features and advantages will be apparent from the following detailed description of preferred embodiments taken in conjunction with the accompanying drawings in which:

FIG. 4 is an isometric view of a light frame.

FIG. 4A is an isometric view of a light frame similar to the light frame illustrated in FIG. 4.

DETAILED DESCRIPTION OF PREFERRED EMBODIMENTS

Figure 1A:
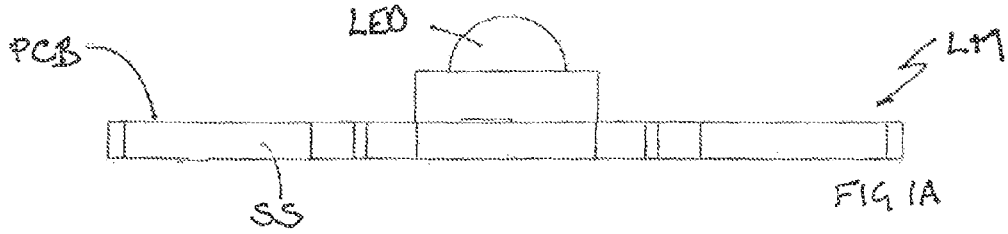
FIG. 1A is a side view of the lighting module illustrated in FIG. 1.
Figure 1:
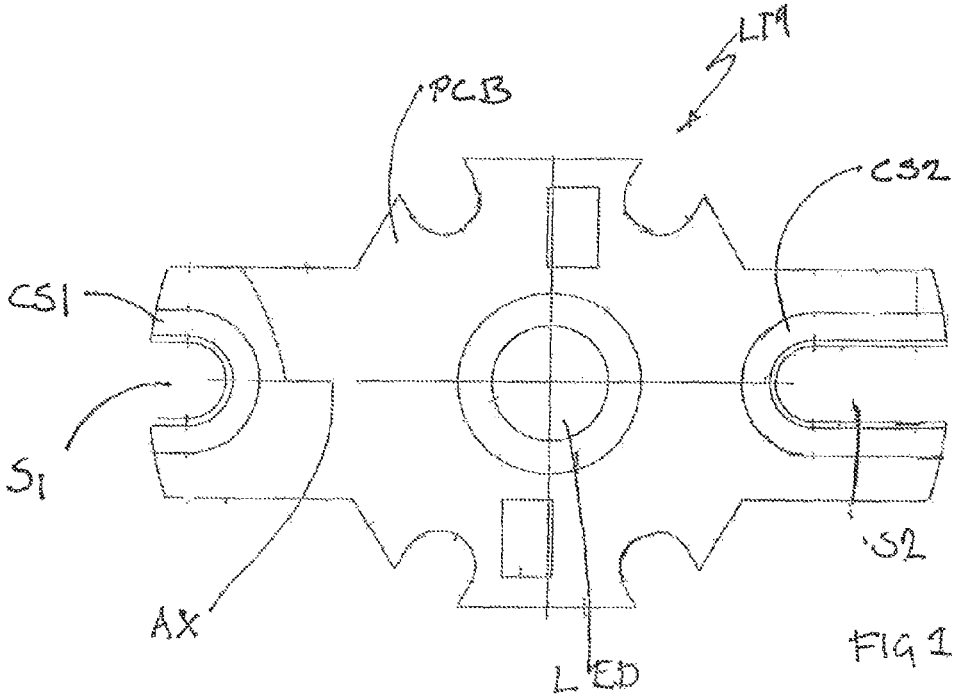
FIG. 1 is a plan view of a lighting module designed to be easily removed and replaced without the complete removal of fasteners.

FIG. 1 is a plan view drawing of a lighting module LM which is the primary component of the LED change-out system as illustrated in FIGS. 3, 3A & 3B, and 3C & 3D. Lighting module LM comprises a light emitting diode LED mounted to a printed circuit board PCB that is laminated onto substrate SS which is primarily composed of a thermal transfer material such as aluminum that transfers heat from the LED. Printed circuit board PCB comprises contact surfaces CS1 and CS2 to which the LED is electrically connected. Said contact surfaces CS1 and CS2 each of which at least partially surround "U" shaped slots S1 and S2 respectively. Said "U" shaped slots S1 and S2 are strategically located along module axis AX.

FIG. 1A is a side view of the lighting module LM as described in FIG. 1 illustrating light emitting diode LED, the printed circuit board PCB, and substrate SS.

Figure 1B:
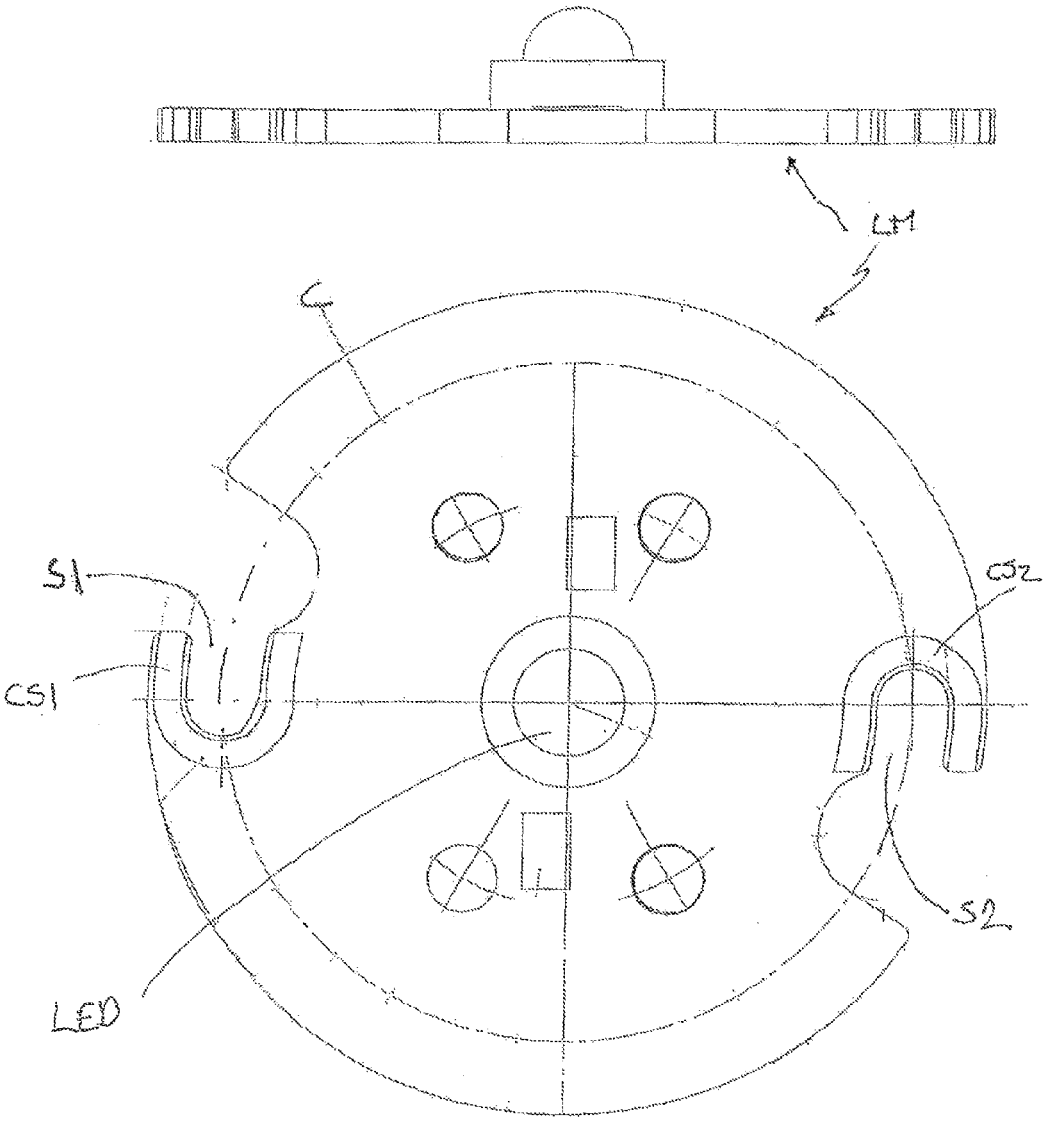
FIG. 1B is a plan view of a lighting module similar to the lighting module illustrated in FIG. 1.

FIG. 1B illustrates a lighting module LM similar in function to the lighting module LM illustrated in FIGS. 1, 3, 3A, and 3B, differing in that slots S1 and S2 are disposed on a circle C, allowing and requiring a rotation of said light module LM for removal and replacement of said light module.

Figure 1C:
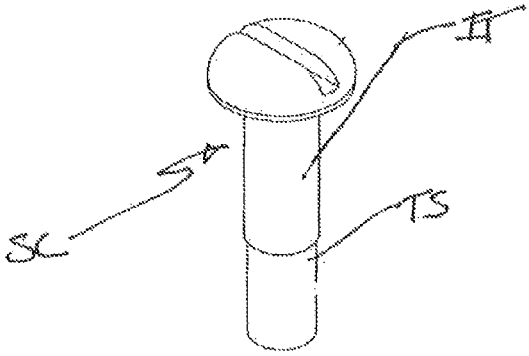
FIG. 1C is an isometric view of a contact screw SC which is a component used to fasten the lighting module to the structure of the lighting system.

FIG. 1C is an isometric view of contact screw SC comprising a threaded screw section TS partially surrounded by a tubular insulating sleeve IT. The functions of contract screw SC are explained in connection with FIGS. 2, 3, 3A, and 3B.

Figure 1D:
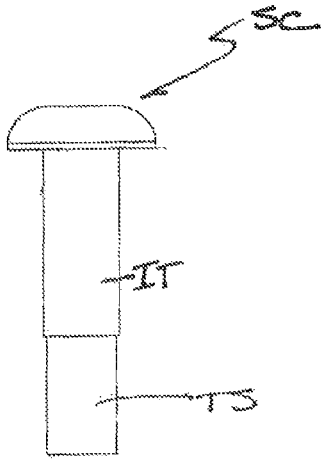
FIG. 1D is a side view of the contact screw described in FIG. 1B.

FIG. 1D is a side view of contact screw SC as described in FIG. 1B.

Figure 2:
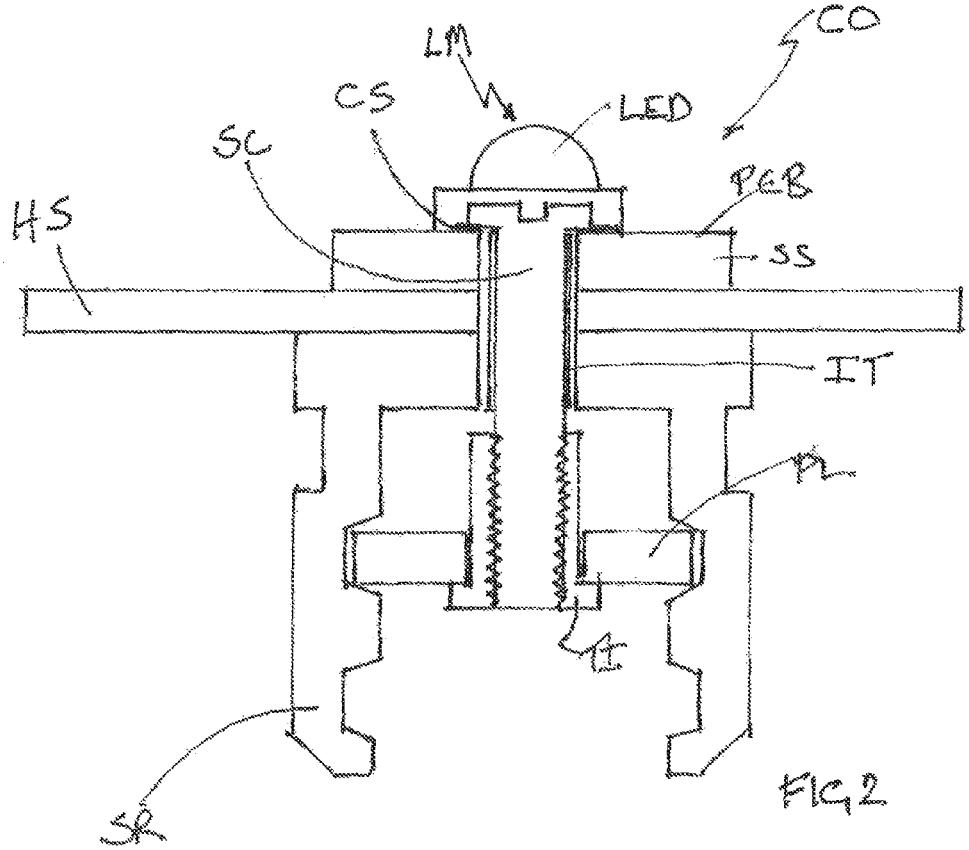
FIG. 2 is an end section view of the components of the changeout system.

FIG. 2 is an end/section view of the LED change-out system CO, in which the primary functions of lighting module LM and contact screw SC are explained. The functions of contact screw SC are: first, to maintain electrical continuity between the contact surfaces CS located on the electrical power circuit on the printed circuit board PCB. This is achieved with the contact screw SC is tightened into threaded insert TI which is in electrical contact with the power circuit on the printed circuit board PCB. The insulation sleeve IT keeps contact screw SC from short circuiting onto heat sink HS, said aluminum substrate SS of the lighting module LM and/or the metal composition of support rail SR. Second, contact screw SC holds lighting module LM firmly and flatly to heat sink HS so that heat generated by the LED can transfer from the light module LM to heat sink HS and in turn from heat sink HS to support rail SR. In some embodiments, lighting module LM can be mounted directly to support rail SR when support rail SR has the heat dissipation qualities that are required, eliminating the need for heat sink HS; in other embodiments rail SR may be comprised of a non-heat transfer material such as plastic or glass. A third function of contact screw SC is to provide structural integrity by securing components, light module LM, heat sink HS and structural rail SR to hold firmly to each other. A fourth function of contact screw SC is to provide a means for change-out (replacement) of light emitting diode LED which is fully described in connection with FIGS. 3, 3A, 3B, 3C and 3D.

Figure 3:
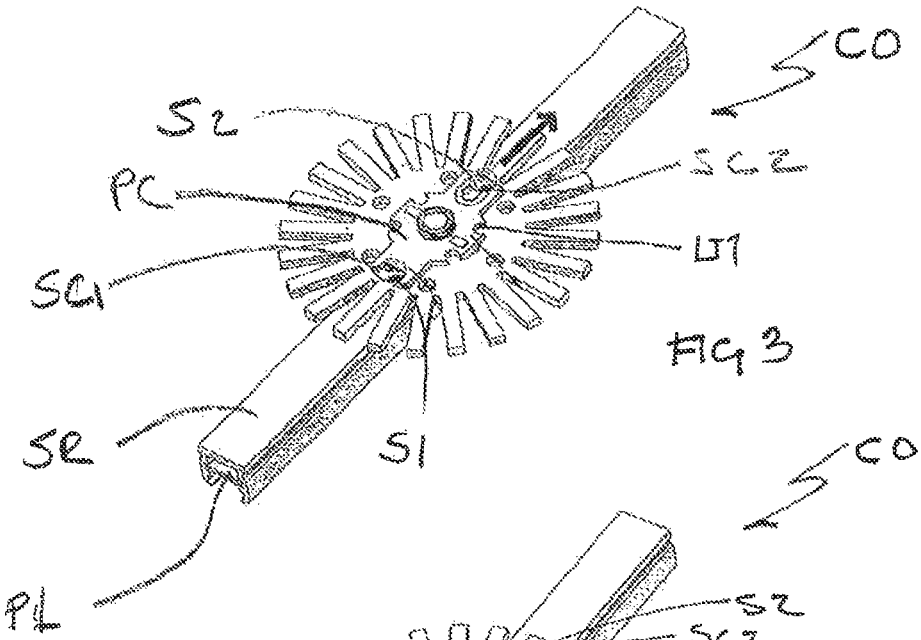
FIGS. 3, 3A, & 3B are isometric views of the LED change-out system.
Figure 3A:
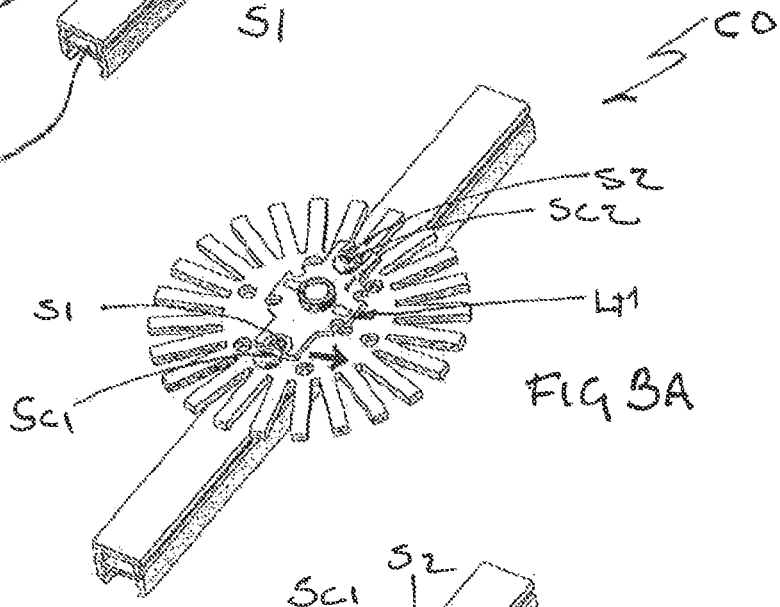
Figure 3B:
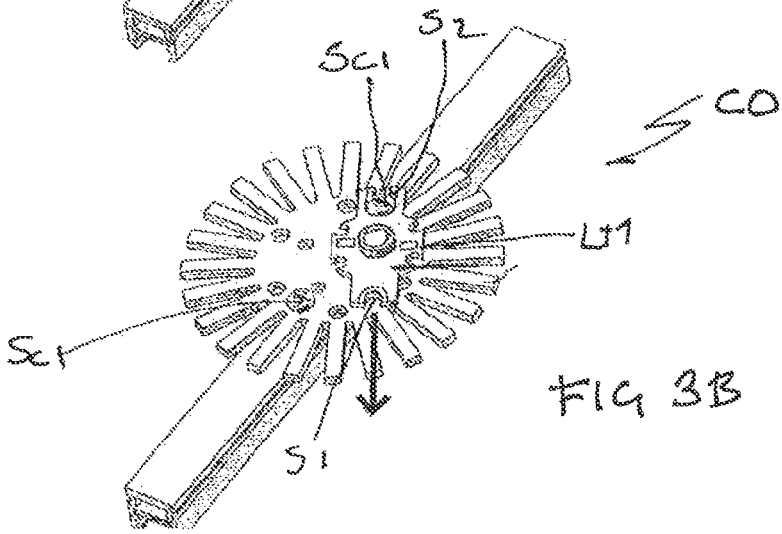

FIGS. 3, 3A, and 3B are isometric views of the LED change-out system illustrated in FIG. 2. Referencing the shape of slots 51 and S2 in relation to the centers of locations of contact screws SC1 and SC2, it should be evident that by loosening said screws' light module LM can be manually slid in a linear direction under the heads of said contact screws towards contact screw SC2, freeing slot S1 from contact screw SC1, allowing light module LM to rotate as illustrated in FIG. 3A and finally to be pulled away from under the head of contact screw SC2 as illustrated in FIG. 3B. Another light module LM can be made to replace the removed lighting module LM by reversing the steps described in FIGS. 3B, 3A, and 3 and finally tightening screws SC1 and SC2.

Figures 3C, 3D:
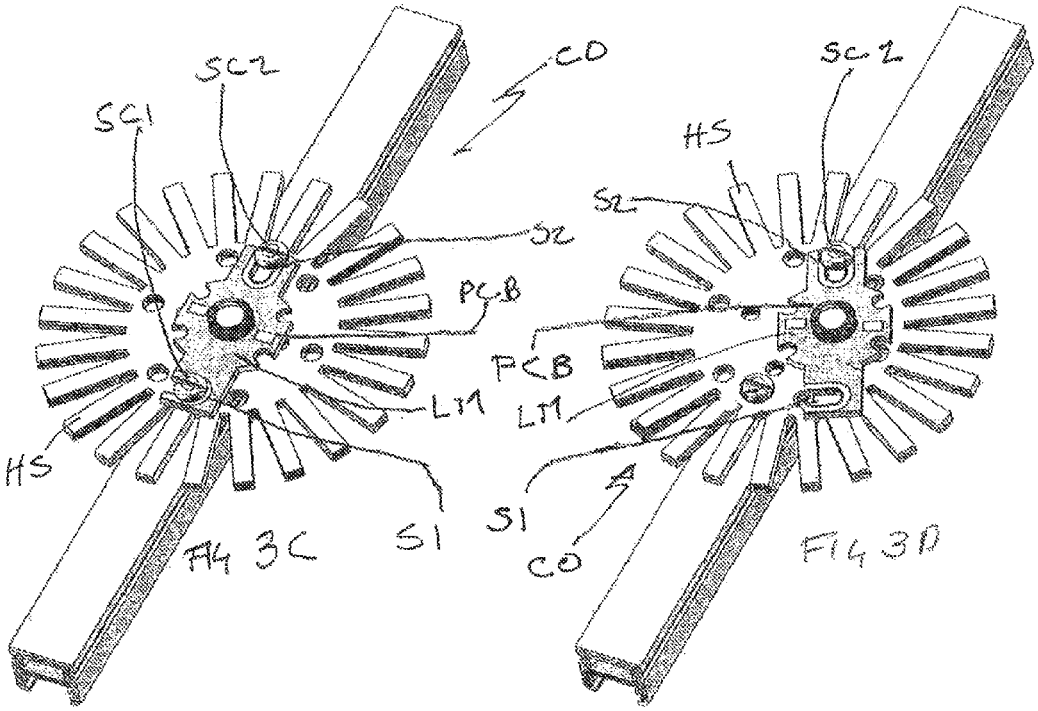
FIGS. 3C and 3D are isometric views of the changeout system that is similar to that shown in FIGS. 3, 3A & 3B.
Figure 9:
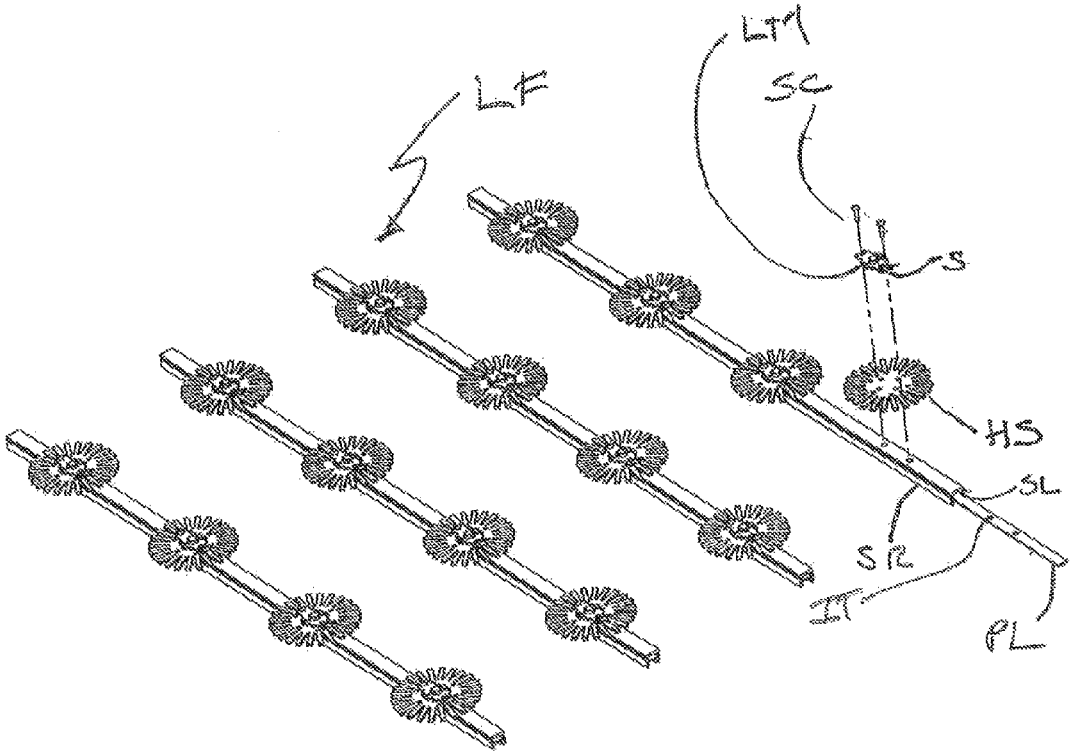

FIGS. 3C and 3D are isometric views of a change-out LED system similar to that illustrated in FIGS. 3, 3A, and 3B differing in that the slot S1 of light module LM in FIGS. 3C and 3D are disposed in such a position as to allow light module LM to be first rotated about and then drawn away from contact screw SC2, releasing said light module LM from the heat sink HS.

FIG. 4 is an isometric view of a light frame system LF comprising a series of component configurations described in FIGS. 2 through 3D, mounted along structural rails SR. In addition, a portion of FIG. 4 includes an exploded isometric of how said components are assembled together. Contact screws SC pass through said slots S of light module LM, further through holes in heat sink HS, then through holes in support rail SR and finally screwed into thread inserts at which have been placed into position by sliding printed circuit board PL within slot SL in support rail SR.

FIG. 4A is an isometric view of a light frame system LF similar to the light frame system LF illustrated in FIG. 4, differing in that bridge rails BR bridge between and to structural rails SR. Methods for attaching said bridge rails BR to said structural rails SR can include but are not limited to using rivets RV through heat sink HS into SR, or screws to achieve the same, or welding if required. In instances (embodiments) where the heat sink HS is not required, when light module LM is mounted directly to either the structural rail SR or the bridge rail BR, said rails can be fastened together with angle brackets or structural components. Also the distances between the centers of either the structural rails SR or the bridge rails BR relatively DX and DY can be varied to lighting and structural requirements of the structural rail system.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

The invention claimed is:

1. An illumination system for creating a field of light with which density, photometric angular distribution, of projected light can be changed, comprising:

a. a series of light modules including at least one LED;

b. a structural frame of structural rails having electrically insulating elements, within which electrical conductors pass, said structural rails at least partially composed of a heat conductive material;

c. a circuit board including a heat conductive substrate having slots disposed about the circuit board, and including at least two electrical contact surfaces located along the slots on said circuit board said LED being mounted to said circuit board, said circuit board further including at least two electrical contact surfaces strategically located along said slots;

d. electrically conductive contact screws for electrically connecting the LEDs on said circuit board to the electrical conductors and constructed and arranged to simultaneously provide a thermal transfer from said heat conductive substrate to said structural rails, said screws having a threaded portion of such diameter that they fit within the slots of said circuit board, the heads of said screws having a larger diameter than said slots and making contact with said contact surfaces when said screws are tightened.

2. An illumination system as in claim 1 wherein the circuit board includes a constant current drive circuit to control the current going to the LED.

3. An illumination system as in claim 1 wherein a heat sink is disposed between said heat conductive substrate and said structural rail, and being held in secure contact and attached to said rails by said contact screws.

4. An illumination system as in claim 3 wherein said light module is integrated into said heat sink, said heat sink including said printed circuit board, said contact surfaces and said slots.

5. An illumination system as in claim 1 wherein the slots in said circuit board are disposed along a linear axis along said circuit board so that installing and removing said circuit board requires a lineal movement of said circuit board.

6. An illumination system as in claim 1 wherein the centers of the slots in said circuit board are disposed along a circle so that installing and removing said circuit board requires a rotary motion, said slots being in the form of key way slots.

7. An illumination system as in claim 1 wherein the cross-section of said structural rail is a channel, said channel having linear grooves which provide positioning and assembly for the combined electrically insulating elements and electrical conductors.

8. An illumination system as in claim 7 wherein said combined electrically insulating elements is a printed circuit board having connecting nuts into which said contact screws fasten.

9. An illumination system as in claim 7 wherein said combined electrically insulating elements and electrical conductors are removable and may be replaced by unscrewing said contact screws and sliding said printed circuit board along said rails and out the end of said channel.

10. An illumination system as in claim 7 wherein said contact screws include an insulating sleeve.

11. An illumination system comprising:

a. a printed circuit board bonded to a heat conducting substrate;

b. at least one lighting module having a quasi point light source mounted to said printed circuit board, said circuit board having at least two slots located about said circuit board, each said slot at least partially surrounded by an electrical contact surface that provides electrical continuity to said quasi point light source;

c. a component surface onto which said lighting module is mounted, said component surface including an insulating material through which electrical conductors are located, said electrical conductors having threaded nuts attached, the spacing between said threaded nuts being equal to the spacing between the slots in said circuit board;

d. at least two electrical contact screws which, by being tightened into said threaded nuts secure said lighting module to said component surface and provide electrical continuity between electrical contact surfaces on the printed circuit board to said electrical conductors of said component surface;

e. shape and location of the said slots on said circuit board matching said location of said nuts on said conductors and being so aligned as to allow the lighting module to be removed and replaced by loosening and tightening, and not requiring the removal, of said electrical contact screws.

12. An illumination system as in claim 11 wherein said lighting plane comprises a structural frame system.

13. An illumination system as in claim 12 wherein said structural frame system includes structural channels.

14. An illumination system as in claim 13 within which at least one channel and insulator further comprising electrical conductors is disposed, said electrical conductors having said threaded nuts to receive said electrical contact screws.

15. An illumination system as in claim 13 wherein said structural channels are at least partially composed of a thermally conductive material.

16. An illumination system as in claim 11 wherein said light module includes a constant current drive circuit.

17. An illumination system as in claim 11 wherein said slots are disposed along a linear axis along said light module.

18. An illumination system as in claim 11 wherein said slots are disposed on a circumferential axis around said quasi point light source.

19. An illumination system as in claim 11 wherein a heat sink is mounted between said light module and said component surface.

20. An illumination system as in claim 19 wherein said light module and said heat sink are integrated into a single component.

21. An illumination system as in claim 1 wherein the rails are aluminum.

* * * * *